US006431226B1

(12) United States Patent
Koslowsky

(10) Patent No.: US 6,431,226 B1
(45) Date of Patent: Aug. 13, 2002

(54) REFUELLING ROBOT

(75) Inventor: Uwe Koslowsky, Geseke (DE)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 09/869,233

(22) PCT Filed: Aug. 27, 1999

(86) PCT No.: PCT/EP99/06334

§ 371 (c)(1),
(2), (4) Date: Jun. 25, 2001

(87) PCT Pub. No.: WO00/12362

PCT Pub. Date: Mar. 9, 2000

(30) Foreign Application Priority Data

Aug. 28, 1998 (DE) ..... 298 15 512 U

(51) Int. Cl.[7] ..... B65B 1/04
(52) U.S. Cl. ..... 141/98; 141/392; 901/16; 901/41

(58) Field of Search ..... 141/98, 392, 94, 141/231, 387, 104; 901/15, 16, 41

(56) References Cited

U.S. PATENT DOCUMENTS 5,309,959 A * 5/1994 Shaw et al. ..... 141/103
5,634,503 A * 6/1997 Musil et al. ..... 137/234.6
5,672,044 A * 9/1997 Lemelson ..... 414/744.3
5,758,701 A * 6/1998 Corfitsen ..... 141/382

* cited by examiner

*Primary Examiner*—Steven O. Douglas
(74) *Attorney, Agent, or Firm*—Withrow & Terranova PLLC

(57) ABSTRACT

A refuelling robot having a robot tower, which can be moved along a plinth, can be swivelled and has extending from it a robot arm with, at its free end, a filling nozzle, has separate fuel lines for the various types of fuel as far as the robot arm, but combines at least some of these lines into a single line for transition into the arm itself and out through the nozzle. In this way all the usual fuel types can be dispensed while at the same time reducing the outlay on fuel lines.

12 Claims, 1 Drawing Sheet

REFUELLING ROBOT

BACKGROUND OF THE INVENTION

The invention concerns a refuelling robot, having a robot tower which is linearly displaceable on a plinth portion and can be swivelled about a vertical axis and from which a robot arm extends, the arm can be swivelled about its axis and having a filling nozzle at its free end. Such a robot may typically be employed on a fuel station forecourt to enable the automated refuelling of vehicles, and one such robot is disclosed in DE-A-42 42 243.

It is the purpose of the invention to improve the fuel-line arrangement extending between a pump housing, which is disposed in the plinth portion, and the filling nozzle in such a manner that all current types of fuel may be conveyed to the filling nozzle, whilst reducing expenditure on fuel lines.

SUMMARY OF THE INVENTION

According to the present invention there is provided a refuelling robot including a robot tower, which is linearly displaceable on a plinth portion and can be swivelled about a vertical axis, from which tower a robot arm extends, which arm can swivel about its axis and carries at its free end a filling nozzle, wherein separate and at least partially flexible fuel lines associated with respective different types of fuel are provided as far as the robot arm, wherein at least some of the fuel lines being combined immediately before their transition to the robot arm such that they share a common flow path through at least part of the robot arm.

Essentially, the object is achieved by the provision of, for different types of fuel, separate, partially flexible fuel lines as far as the robot arm, at least some of these individual lines being joined immediately prior to their transition to the robot arm. This transition will in most cases involve continuing the combined line inside the arm, though it is conceivable to run the combined line outside the arm. In this respect it is advantageous if, prior to this transition, all petrol fuel lines are combined into a single line. It is advantageous if the individual fuel lines for diesel-type fuel are continued either as separate items or also as one item, to prevent cross-contamination with petrol. Where the diesel lines are continued as a single line, there will be only two fuel lines in the robot arm: one for petrol, the other for diesel. Both these lines are continued as far as the filling nozzle, where they combine to form the nozzle pipe which empties after the refuelling process.

The combining of the fuel lines immediately ahead of the robot arm preferably takes place in a manifold, which accepts the individual lines in the form of hoses. These lines have C-shaped curvatures within the tower to provide slack so that the robot arm can be moved up and down vertically by a certain amount along an outer wall of the robot tower. It is also possible for the robot tower to rotate through, in total, 180° in order to serve two refuelling sites situated one opposite the other. The robot tower may move linearly in a horizontal plane on the plinth portion, for which purpose the individual hoses in the plinth portion lie curved in a "U" shape, thereby providing slack. Preferably the filling nozzle, which is disposed at the free end of the robot arm, is rotatable about an axis which is perpendicular to the axis of rotation of the robot arm. At the joints between the robot tower and the robot arm or between the robot arm and the filling nozzle, fuel is conveyed through rotary lead through elements, these elements containing at least one radial inlet and at least one axial outlet.

BRIEF DESCRIPTION OF THE DRAWINGS

An embodiment of the invention is described below with the aid of the attached drawings, which show.

DETAILED DESCRIPTION OF THE DRAWINGS

Figure 1:
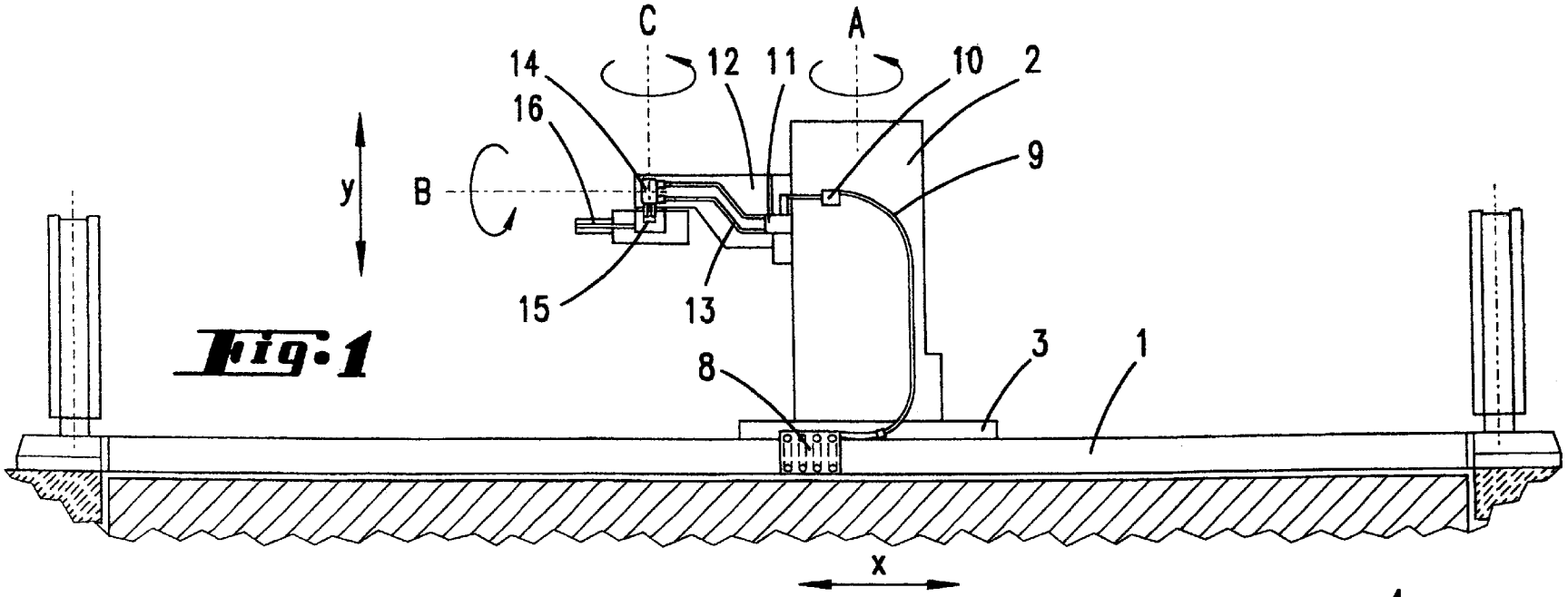
FIG. 1 a partially sectional view through the refuelling robot of the invention, and FIG. 2 a plan view.
Figure 2:
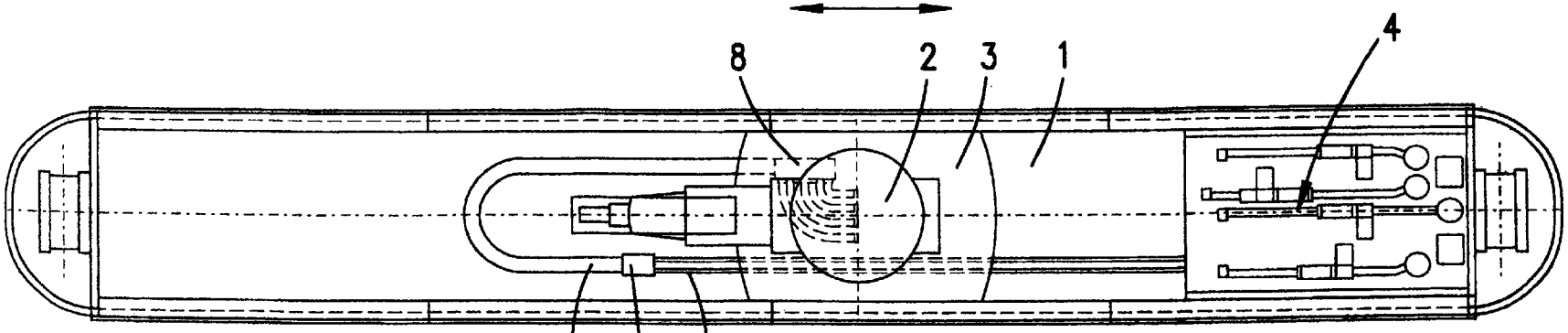

At ground level and in the horizontal plane there is a plinth portion 1, with respect to which a robot tower 2 can be moved in a horizontal direction, as shown by arrow "x". The tower may be moved by motor power and under remote control, if necessary. The robot tower 2 is mounted on a base plate 3 to which a curve-guide block 8 for a plurality of individual fuel lines for different types of fuel is secured.

A robot arm 12 protrudes horizontally from a side wall of the tower 2. The tower 2 can turn through a total of 180° also under motor power, with the result that the robot arm 12 can serve two refuelling bays situated one opposite the other. Robot arm 12 can also be displaced vertically up and down in the direction "y" along the wall of tower 2 and is supported on tower 2 so it can swivel through 360° on axis B. These movements too are motor-driven. While the axis of rotation A of the tower is vertical, the axis of rotation B of the robot arm 12 is horizontal.

The free end of robot arm 12 carries a filling nozzle 15 which can swivel about an axis C perpendicular to axis B and includes a filling tube 16 which extends transversely to the direction of axis C.

The fuel coming from the storage tank is conveyed to a pump chamber 4, which contains the usual solenoid valves, measuring instruments, filters and non-return valves, and goes through a fixed pipe line 5 to a transition piece 6 in the plinth portion 1. A U-shaped hose line 7 is connected to the transition piece 6. The hose line 7 consists of a plurality of individual hoses, of the same number as there are types of fuel to be delivered. All individual hoses are held together in a sheath through which supply and signalling cables for the drive motors may also be taken.

A curve-guide block 8 is attached to the base of robot tower 2, and to this curve-guide block piece each of the ends of the hoses 7 is affixed. The whole set of individual lines is connected by means of this multiple curve-guide block 8 to a plurality of hoses 9 bent in the shape of a "C". The C-shaped curvature of the individual hoses 9 provides slack and is chosen so that the hose guide 7 can go as far as the inner housing wall of the tower. The outlet ends of the individual hoses 9 are attached to a manifold 10, which can be moved vertically together with the robot arm 12. The number of inlets into manifold 10 corresponds to the number of individual lines. The number of outlets from manifold 10 is less. In the manifold 10 all individual petrol lines are combined into one continuing line. The individual diesel-fuel lines are likewise combined into a single line but, as a rule, there is only one diesel line provided which can then be continued as an individual line.

To the manifold 10 a rotary lead through element 11 is connected in the direction of delivery. The rotary lead through has two axial outputs for the motor-fuel line 13 and the diesel-fuel line 13. The associated inlets are radially situated on the rotary lead through element 11.

Both delivery lines 13 are formed from flexible tubular conduits or hoses and lead in a radial direction in the direction of flow into a further rotary lead through element 14. This rotary lead through element 14 also has axial outputs, which lead into a single pipe 16 of the filling nozzle 15.

The rotary lead through elements 11 and 14 are designed so that the robot arm 12 and filling nozzle 15, respectively, can be swivelled under motor power through 360°.

The present invention minimises the number of flow paths in the robot arm by combining the flow paths prior to the robot arm and, in the embodiment illustrated, the combined flow path then continues as far as the nozzle. However, if the volume of fuel contained in the flow path between the manifold 10 and nozzle 15 is greater than that permitted by legislation, in order to avoid contamination of a fuel delivery by residual fuel left over in a flow path from a previous transaction, the flow path can branch out after the lead through element 11 back into its separate individual flow paths, using for example a manifold similar to the manifold 10. A further manifold would then be employed at some point prior to the lead through element 14 in order to reduce once more the number of lines entering the nozzle. A valve need only be incorporated in each individual flow path in the arm between the two additional manifolds to activate the particular flow path associated with the type of fuel to be dispensed. In this manner, and where the further manifold is situated just before the lead through element 14, the residual-fuel volume of possibly a different grade of fuel from that required in a current transaction is limited to the volumes in the lead through element 11, the additional manifolds, the lead through 14 and the nozzle itself.

What I claim is:

1. A refueling robot for dispensing fuel, comprising:

a robot tower which is linearly displaceable on a plinth portion and can be swiveled about a vertical axis, from which tower a robot arm extends, which arm can swivel about its axis and carries at its free end a filling nozzle, wherein separate and at least partially flexible fuel lines associated with respective different types of fuel are provided as far as said robot arm, wherein at least some of said fuel lines are combined immediately before their transition to said robot arm such that they share a common flow path through at least part of said robot arm.

2. A refueling robot according to claim 1, wherein said fuel lines in their transition to said robot arm are taken inside said robot arm.

3. A refueling robot according to claim 1, wherein said separate fuel lines for conveying fuel are combined into one continuing line.

4. A refueling robot according to claim 1 wherein said combining takes place in a manifold.

5. A refueling robot according to claim 1, wherein said separate lines in said tower are in the form of hoses led in a chain or sheath.

6. A refueling robot according to claim 5, wherein said hoses follow a C-shaped curvature so as to provide slack.

7. A refueling robot according to claim 5, wherein said hoses in the plinth portion follow a U-shaped curvature.

8. A refueling robot according to claim 1, wherein said robot arm is linearly displaceable in a vertical direction on said tower.

9. A refueling robot according to claim 1, wherein said filling nozzle is rotatable about an axis which is perpendicular to the rotational axis of said robot arm.

10. A refueling robot according to the claim 1, wherein the fuels at the joints between said robot arm and said tower and/or between said filling nozzle and said arm are taken through rotary lead through elements having at least one radial inlet.

11. A refueling robot according to claim 1, wherein said combined fuel line in said robot arm is split back into its separate lines for the various fuel types for a given portion of the length of said robot arm and these separate lines then re-combined for transition to said filling nozzle.

12. A refuelling robot according to claim 11, wherein said splitting back and re-combining take place in respective manifolds.

* * * * *